US011201046B2

(12) United States Patent
Kudo et al.

(10) Patent No.: US 11,201,046 B2
(45) Date of Patent: Dec. 14, 2021

(54) ORTHOGONAL ACCELERATION TIME-OF-FLIGHT MASS SPECTROMETER AND LEAD-IN ELECTRODE FOR THE SAME

(71) Applicant: SHIMADZU CORPORATION, Kyoto (JP)

(72) Inventors: Tomoya Kudo, Kyoto (JP); Yusuke Sakagoshi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/053,091

(22) PCT Filed: May 30, 2018

(86) PCT No.: PCT/JP2018/020673
§ 371 (c)(1),
(2) Date: Nov. 5, 2020

(87) PCT Pub. No.: WO2019/229864
PCT Pub. Date: Dec. 5, 2019

(65) Prior Publication Data

US 2021/0142999 A1 May 13, 2021

(51) Int. Cl.
*H01J 49/40* (2006.01)
*H01J 49/06* (2006.01)
(Continued)

(52) U.S. Cl.
CPC ..... *H01J 49/401* (2013.01); *H01J 19/44* (2013.01); *H01J 29/82* (2013.01); *H01J 49/061* (2013.01);
(Continued)

(58) Field of Classification Search
CPC ..... H01J 49/401; H01J 49/403; H01J 49/061; H01J 49/068; H01J 49/22; H01J 29/82; H01J 19/44
(Continued)

(56) References Cited

U.S. PATENT DOCUMENTS

2002/0100870 A1* 8/2002 Whitehouse ..... B82Y 30/00 250/281
2014/0008531 A1 1/2014 Furuhashi et al.
(Continued)

FOREIGN PATENT DOCUMENTS

JP 5299476 B2 9/2013
JP 5772967 B2 9/2015
(Continued)

OTHER PUBLICATIONS

International Search Report for PCT/JP2018/020673 dated Jul. 31, 2018 (PCT/ISA/210).
(Continued)

*Primary Examiner* — Kiet T Nguyen
(74) *Attorney, Agent, or Firm* — Sughrue Mion, PLLC

(57) ABSTRACT

A lead-in electrode, of an orthogonal acceleration time-of-flight mass spectrometer, includes: a main body having an ion passing part and a first member including a main-body accommodating part that is a through-hole. One surface of the first member includes an extension part to define a position of one surface of the main body. A second member is attached to the first member. A through-hole is provided at a position of the second member. One surface of the second member includes a first area in contact with a surface opposite to the one surface of the first member and a second area located inside with respect to the first area. The second area is formed lower than a surface, of the first area, in contact with the surface opposite to the one surface. A
(Continued)

lead-in electrode elastic member is disposed, in the second area, between the first member and second members.

10 Claims, 8 Drawing Sheets

(51) Int. Cl.
*H01J 49/22* (2006.01)
*H01J 19/44* (2006.01)
*H01J 29/82* (2006.01)

(52) U.S. Cl.
CPC ..... *H01J 49/068* (2013.01); *H01J 49/22* (2013.01); *H01J 49/403* (2013.01)

(58) Field of Classification Search
USPC ..... 250/287
See application file for complete search history.

(56) References Cited

U.S. PATENT DOCUMENTS

2014/0224982 A1 8/2014 Furuhashi
2021/0202222 A1* 7/2021 Carney ..... H01J 49/04
2021/0210329 A1* 7/2021 Carney ..... H01J 49/063

FOREIGN PATENT DOCUMENTS

WO 2012/132550 A1 10/2012
WO 2013/051321 A1 4/2013

OTHER PUBLICATIONS

Written Opinion for PCT/JP2018/020673 dated Jul. 31, 2018 (PCT/ISA/237).

* cited by examiner

ORTHOGONAL ACCELERATION TIME-OF-FLIGHT MASS SPECTROMETER AND LEAD-IN ELECTRODE FOR THE SAME

CROSS REFERENCE TO RELATED APPLICATIONS

This application is a National Stage of International Application No. PCT/JP2018/020673 filed May 30, 2018.

TECHNICAL FIELD

The present invention relates to a lead-in electrode which is used in an orthogonal accelerator section included in an orthogonal acceleration type time-of-flight mass spectrometer. The present invention also relates to an orthogonal acceleration type time-of-flight mass spectrometer including such a lead-in electrode.

BACKGROUND ART

In a time-of-flight mass spectrometer (TOF-MS), ions originating from a sample component are made to fly a certain distance of space with a certain kinetic energy given at a predetermined cycle, and a mass-to-charge ratio of the ions are obtained from the time of flight of the ions. At this time, if an initial energy is not uniform (or an initial flight velocity is not uniform) among the ions, there occurs a variation in the time of flight among the ions having the same mass-to-charge ratio, thereby decreasing a mass-resolving power. To solve such a problem, an orthogonal acceleration type time-of-flight mass spectrometer is used (for example, Patent Literature 1). In the orthogonal acceleration type time-of-flight mass spectrometer, a group of ions are accelerated in a direction orthogonal to an incident direction of the group of ions so as to eliminate an influence of the variation in the flight velocity in the incident direction, so that the mass-resolving power is improved.

FIG. 1 shows a schematic configuration of an example of an orthogonal acceleration type time-of-flight mass spectrometer.

Such a mass spectrometer 2 has a configuration of a multistage differential exhaust system including, between an ionization chamber 20 at an approximately atmospheric pressure and an analysis chamber 23 which is vacuum-evacuated at high vacuum by a vacuum pump (not shown), a first intermediate vacuum chamber 21 and a second intermediate vacuum chamber 22 whose degrees of vacuum are stepwise higher in this order. In the ionization chamber 20, an electrospray ionization (ESI) probe 201 is installed to ionize a liquid sample by nebulizing the sample.

The ionization chamber 20 and the first intermediate vacuum chamber 21 communicate with each other through a heated capillary 202 having a small diameter. The first intermediate vacuum chamber 21 and the second intermediate vacuum chamber 22 are separated from each other by a skimmer 212 having a small hole at its top. In the first intermediate vacuum chamber 21, there is disposed an ion guide 211 to transport ions to the subsequent stage while converging the ions. In the second intermediate vacuum chamber 22, there are disposed: a quadrupole mass filter 221 to separate the ions depending on the mass-to-charge ratio; a collision cell 223 equipped with a multipole ion guide 222 inside the collision cell 223; an ion guide 224 to transport the ions ejected from the collision cell 223. A collision-induced dissociation (CID) gas such as argon or nitrogen is supplied to the inside of the collision cell 223.

In the analysis chamber 23 there is provided an ion lens 231 to transport the ions having entered from the second intermediate vacuum chamber 22; an orthogonal accelerator section 232 constituted by two electrodes 232A and 232B which are disposed to face each other across an incident optical axis (in the following, referred to as "ion optical axis") C of ions; a second accelerator section 233 to accelerate the ions exiting from the orthogonal accelerator section 232 toward a flight space; a reflectron 234 (a former-stage reflectron electrode 234A and a subsequent-stage reflectron electrode 234B) which forms a turnover trajectory of the ions in the flight space; a detector 235 to detect the ions flowing in; and a flight tube 236 and a back plate 237 to delimit an outer periphery of the flight space.

One of the pair of electrodes constituting the orthogonal accelerator section 232 that is located on the opposite side of the flight space across the incident optical axis C is called an expulsion electrode. The expulsion electrode 232A is a flat plate-shaped metal member.

The other electrode constituting the orthogonal accelerator section 232 (the electrode located on the flight space side) is called a lead-in electrode. FIG. 2 is a breakdown perspective view of the lead-in electrode 232B. The lead-in electrode 232B is configured by combining an upper member 232B1, a main body 232B2, and a lower member 232B3, which are all metal members. The main body 232B2 is a rectangular plate-shaped member and has: a rectangular ion passing part 232B2*a* in which a large number of minute ion passing holes are formed for ions to pass through the thickness; and a peripheral part 232B2*b* surrounding the ion passing part 232B2*a*. In the upper member 232B1 there is formed a through-hole 232B1*a* having a rectangular cross-section corresponding to an outer shape of the main body 232B2. On the upper end of the upper member 232B1, extension parts 232B1*b* serving as a stopper are provided on parts of the through-hole 232B1*a* (the parts with which the peripheral part 232B2*b* comes in contact when the main body 232B2 is accommodated in the through-hole 232B1*a*) from opposing two long sides. The upper surfaces on the short-side sides of the peripheral of the through-hole 232B1*a* are lower than the upper surfaces on the long-side sides and have the same height as the upper side of the main body 232B2 when the main body 232B2 is accommodated in the through-hole 232B1*a*. Further, in the four corners of the upper member 232B1 there are formed through-holes 232B1*c* through which rod-shaped members 243 (see FIG. 5) are inserted to fix the orthogonal accelerator section 232 to a base plate (not shown). On the lower surface of the upper member 232B1, four bolt holes (not shown) are formed. In the center of the lower member 232B3, there is formed a through-hole 232B3*a* having a circular cross section whose diameter is smaller than the long side of the main body 232B2 and larger than the long side of the ion passing part 232B2*a* of the main body 232B2. Also in the four corners of the lower member 232B3, there are formed through-holes 232B3*c* through which the rod-shaped members 243 are inserted, and through-holes 232B3*d* for bolts to be inserted are formed at positions each corresponding to one of the four bolt holes formed in the upper member 232B1.

The minute ion passing holes formed in the ion passing part 232B2*a* of the main body 232B2 are constituted by alternately stacking a plurality of plate-shaped members and rod-shaped members as described, for example, in Patent Literature 2. Due to such construction, variation in thickness of the main body 232B2 tends to occur in manufacturing. In the case of the orthogonal accelerator section 232, if the degree of parallelism between the lower surface of the expulsion electrode 232A and the upper surface of the ion passing part 232B2*a* of the lead-in electrode 232B is poor, a variation occurs in an energy given to the ions and in an acceleration direction depending on the position in the orthogonal accelerator section 232, and resolution power and measurement sensitivity are deteriorated. Therefore, it is necessary to assemble the lead-in electrode 232B such that the upper surface of the ion passing part 232B2*a* and the lower surface of the expulsion electrode 232B1 are parallel to each other even if there is a slight variation in the thickness of the main body 232B2.

FIG. 3 is a perspective view of the conventionally used lead-in electrode 232B. FIG. 4A and FIG. 4B are cross-sectional views of the lead-in electrode 232B taken along line A-A' and line B-B', respectively. The main body 232B2 is manufactured to have a thickness slightly larger than the height of through-hole 232B1*a* of the upper member 232B1 (the height of the part except extension parts 232B1*b*). When the upper member 232B1 and the lower member 232B3 are vertically disposed to sandwich the main body 232B2, the lower surface of the main body 232B2 and the upper surface of the lower member 232B3 are in contact with each other, and there is a gap between the lower surface of the upper member 232B1 and the upper surface of the lower member 232B3. In this state, bolts are inserted from the lower surface of the lower member 232B3 to firmly fix the lower member 232B3 to the upper member 232B1. With this arrangement, the upper surface of the main body 232B2 (that is, the upper surface of the ion passing part 232B2*a*) is pressed against the extension parts 232B1*b* of the upper member 232B1 and is thus fixed at a predetermined position; therefore, even when there is some variation in the thickness of the main body 232B2, it is possible to keep good parallelism between the upper surface of the ion passing part 232B2*a* and the lower surface of the expulsion electrode 232A.

CITATION LIST

Patent Literature

Patent Literature 1: WO 2012/132550 A
Patent Literature 2: WO 2013/051321 A

SUMMARY OF INVENTION

Technical Problem

In the case where the lead-in electrode 232B is constructed as described above, even when there is some variation in the thickness of the main body 232B2, it is possible to uniformly accelerate the ions having entered the orthogonal acceleration region. However, as understood from FIG. 4, the lower surface of the conventional lead-in electrode 232B (that is, the lower surface of the lower member 232B3) is curved. As a result, there is a following problem: a distortion occurs in the electric field formed between the lead-in electrode 232B and the second accelerator section 233, and the ions having exited from the orthogonal accelerator section 232 are therefore not uniformly accelerated by the second accelerator section 233, which deteriorates the resolution power and the sensitivity.

An object to be solved by the present invention is to provide a lead-in electrode which is used to lead in ions and can uniformly accelerate the ions by an orthogonal accelerator section that accelerates the ions having entered an orthogonal acceleration region of an orthogonal acceleration type time-of-flight mass spectrometer, in a direction orthogonal to an incident direction of the ions.

Solution to Problem

A lead-in electrode, of an orthogonal acceleration time-of-flight mass spectrometer, according to the present invention made to solve the above object includes:

(a) a main body having a plate shape, the main body having an ion passing part;

(b) a first member which is a plate-shaped member in which there is provided a main-body accommodating part which is a through-hole and accommodates the main body, wherein on one surface of the first member there is provided an extension part to delimit the position of one surface of the main body accommodated in the main-body accommodating part;

(c) a second member which is a plate-shaped member and is to be attached to the first member accommodating the main body in the main-body accommodating part, wherein a through-hole is provided at such a position of the second member that at least a part of the ion passing part is not blocked, and on one surface of the second member there are formed a first area which is in contact with a surface opposite to the one surface of the first member and a second area which is located inside with respect to the first area and is formed lower than a surface, of the first area, in contact with the surface opposite to the one surface of the first member; and (d) an elastic member disposed, in the second area, between the main body and the second member.

The above expression "a through-hole is formed at such a position of the second member that at least a part of the ion passing part is not blocked" means that the through-hole is formed such that at least a part of the ions having passed through the ion passing part pass through the through-hole. Of course, it is preferable to form such a through-hole that all of the ions passing through the ion passing part pass through the through-hole.

The above expression "a second area which is located inside with respect to the first area and is formed lower than a surface, of the first area, in contact with the one surface" means that the second area is formed on the through-hole side with respect to the first area and is located on an opposite side of the side on which the first member and the main body are attached.

The lead-in electrode according to the present invention is assembled such that the main body is fixed by being sandwiched by the first member and the second member. The main body is accommodated in the through-hole of the first member. Further, on the one surface of the first member, there is provided the extension part defining the position of the one surface of the main body accommodated in the main-body accommodating part. The following areas are formed on the one surface of the second member to which the first member, in the through-hole of which the main body is accommodated, is attached: the first area which is in contact with the surface on the side opposite to the side on which the extension part of the first member is provided; and the second area which is located inside with respect to the first area and is formed lower than the contact surface of the first area. In the second area, the elastic member is disposed between the main body and the second member. In the lead-in electrode according to the present invention, when the first member and the second member are fixed to each other, the elastic member is deformed depending on the variation in the thickness of the main body, and the position of the main body is determined while the one surface of the main body is pressed against the extension part of the first member via the elastic member. Further, the first member comes in contact with the first area formed on the second member; therefore, unlike the conventional art, there is no possibility of the bottom surface side (the side opposite to the first member and the main body) of the second member being curved when the first member and the second member are fixed to each other. Therefore, distortion does not occur in the electric field formed between the second member and the second accelerator section disposed on a subsequent stage of the second member, and it is therefore possible to accelerate the ions uniformly.

In addition, the second area is preferably formed in a recessed shape. By using such a configuration, the elastic member can be accommodated in the recessed shape part at the time of assembly, thereby making the assembly work easier.

In conventional orthogonal acceleration type time-of-flight mass spectrometers, the orthogonal accelerator section 232 (the expulsion electrode 232A and the lead-in electrode 232B) and the second accelerator section 233 are positioned by alternately disposing the spacers 242 and the electrodes on the base plate 241, as shown in FIG. 5. Specifically, the second accelerator section 233 configured with a predetermined number of electrodes (three electrodes in the drawing) is attached by repeating an operation of inserting a toroidal-shaped spacer member 242 on each of the four rod-shaped members 243 fixed to the base plate 241 and then inserting one of the electrodes constituting the second accelerator section 233. Next, the spacer member 242 is inserted on the second accelerator section 233, and the lead-in electrode 232B is inserted on the spacer member 242. The spacer member 242 is further inserted on the lead-in electrode 232B, and the expulsion electrode 232A is inserted on the spacer member 242. Finally, by attaching nuts 244 to the rod-shaped members 243 over the expulsion electrode 232A or by another method, the orthogonal accelerator section 232 and the second accelerator section 233 are fixed to the base plate 241.

However, when the electrodes are being fixed in such a method, errors in the thickness and the unparallelism of each spacer member 242 and each electrode 233 are accumulated every time when the spacer member 242 is inserted. There is a following problem. Since the expulsion electrode 232A and the lead-in electrode 232B are fixed to the base plate 241 via the spacer members 242 and the electrodes 233, such errors are accumulated, and the accumulated errors deteriorates the degree of parallelism between the opposing surfaces of the both electrodes, uniformity of distances from the base plate 241 to the both electrodes, and the degree of parallelism between the base plate 241 and the both electrodes. As a result, the ions are not uniformly accelerated, thereby deteriorating the resolution power and the sensitivity.

To address this problem, an orthogonal acceleration time-of-flight mass spectrometer according to the present invention preferably includes:

(e) an orthogonal accelerator section having the lead-in electrode and an expulsion electrode;

(f) a second accelerator section constituted by one or a plurality of electrodes;

(g) a base plate;

(h) a plurality of rod-shaped members provided to stand on the base plate;

(i) first spacer members each of which is a member attached to a respective one of the plurality of rod-shaped members and defines a distance from the base plate to the lead-in electrode;

(j) second spacer members each of which is a member attached to a respective one of the plurality of rod-shaped members and defines a distance from the lead-in electrode to the expulsion electrode; and (k) third spacer members each of which is a member attached to a respective one of the rod-shaped members and defines a distance from the base plate to an electrode which is one of the electrodes constituting the second accelerator section and is disposed at a position closest to the base plate.

In the time-of-flight mass spectrometer of the above configuration, the following members are configured as individual members and attached to the plurality of rod-shaped member without interfering one another: the third spacer members and the fourth spacer members defining the position of each electrode constituting the acceleration unit; the first spacer members defining the distance from the base plate to the lead-in electrode; the second spacer members defining the distance from the lead-in electrode to the expulsion electrode. This configuration defines the positions of the lead-in electrode and the expulsion electrode without the positions being influenced by the errors in the third spacer members and the fourth spacer member, and can improve the accuracies of the degrees of parallelism of these electrodes, the distances from the base plate to these electrodes, and the degrees of parallelism between the base plate and these electrodes.

Further, in the case where the second accelerator section is constituted by a plurality of electrodes, the configuration may further include (l) fourth spacer members each of which is a member attached to a respective one of the rod-shaped members and defines the distances between the electrodes constituting the second accelerator section.

In the orthogonal acceleration type time-of-flight mass spectrometer, an orthogonal accelerator section is disposed in a high vacuum chamber. An intermediate vacuum chamber is disposed on a former stage of the high vacuum chamber. For example, ions having passed through a collision cell disposed in the intermediate vacuum chamber are transported to the orthogonal accelerator section. An ion lens is used to transport the ions from the collision cell to the orthogonal accelerator section. The ion lens is configured by disposing a plurality of circular plate-shaped electrodes each having a hole with a diameter different from one another, and a part of the electrodes (a former stage-side ion lens) and the remaining part (a subsequent stage-side ion lens) are fixed in the intermediate vacuum chamber and the high vacuum chamber, respectively. The former stage-side ion lens is positioned relative to the collision cell, for example. Further, the subsequent stage-side ion lens is positions by the above base plate, for example.

When the ion lenses disposed in the two vacuum chambers are positioned by being fixed to the different members as described above, there may occur a misalignment between the optical axes of the former stage-side ion lens and the subsequent stage-side ion lens. There is a following problem. When an optical axis misalignment occurs between the former stage-side ion lens and the subsequent stage-side ion lens, a part of the ions having passed through the former stage-side ion lens do not enter the subsequent stage-side ion lens, depending on the configuration of the former stage-side ion lens and the subsequent stage-side ion lens, thereby decreasing the sensitivity.

To address the above problem, an orthogonal acceleration type time-of-flight mass spectrometer according to the present invention preferably includes:

(m) a high vacuum chamber in which an orthogonal accelerator section having the lead-in electrode and an expulsion electrode is disposed;

(n) an intermediate vacuum chamber provided on a former stage of the high vacuum chamber; and (o) an ion lens configured with: a former stage-side ion lens which is positioned relative to a member located inside the intermediate vacuum chamber and is constituted by one or a plurality of electrodes in each of which an ion passing opening is formed; and a subsequent stage-side ion lens which is positioned relative to a member located inside the high vacuum chamber and is constituted by one or a plurality of electrodes in each of which an ion passing opening is formed, wherein the ion passing opening in one of the electrodes located on a frontmost stage of the subsequent stage-side ion lens is larger than the ion passing opening of one of the electrodes located on a rearmost stage of the former stage-side ion lens.

In the time-of-flight mass spectrometer of this aspect, the ion lens is divided into the former stage-side ion lens and the subsequent stage-side ion lens such that the ion passing opening formed in the electrode located on the frontmost stage side of the subsequent stage-side ion lens is larger than the ion passing opening formed in the electrode located on the rearmost stage side of the former stage-side ion lens. Due to this arrangement, a small diameter ion beam having passed through the former stage-side ion lens enters the subsequent stage-side ion lens through a hole having a diameter larger than the ion beam. Therefore, even if there is some axial misalignment between the former stage-side ion lens and the subsequent stage-side ion lens, ions are hardly lost, thereby reducing decrease in the sensitivity.

Advantageous Effects of Invention

By using the lead-in electrode according to the present invention or using the time-of-flight mass spectrometer including the lead-in electrode, it is possible to prevent decrease in the resolution power and the sensitivity.

DESCRIPTION OF EMBODIMENTS

Embodiment of a lead-in electrode according to the present invention and a time-of-flight mass spectrometer including the lead-in electrode will be described below with reference to the drawings. Time-of-flight mass spectrometer of the present embodiment is an orthogonal acceleration type time-of-flight mass spectrometer (in the following, also referred to as simply a "time-of-flight mass spectrometer").

Figure 6:
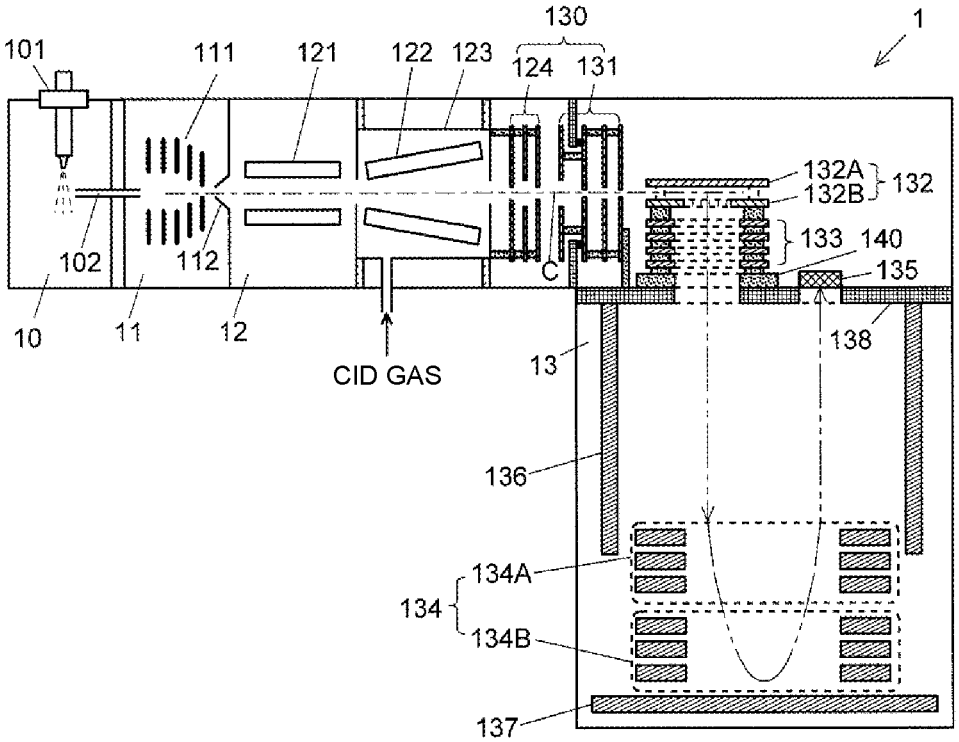
FIG. 6 is a schematic configuration view of an embodiment of an orthogonal acceleration time-of-flight mass spectrometer according to the present invention.

FIG. 6 shows a schematic configuration of a time-of-flight mass spectrometer 1 of the present embodiment. This time-of-flight mass spectrometer includes a first intermediate vacuum chamber 11 and a second intermediate vacuum chamber 12 disposed between an ionization chamber 10 and an analysis chamber 13 such that degrees of vacuum in the chamber are higher stepwise in this order. In the ionization chamber 10 there is disposed an electrospray ion (ESI) source 101 that applies electric charge to a liquid sample and nebulize the charged liquid sample so that the liquid sample is ionized. In this embodiment, the ion source is an ESI source, but another ion source (such as an atmospheric pressure chemical ion source) may be used. Further, the ion source may be an ion source that ionizes a gas sample and a solid sample.

The ions generated in the ionization chamber 10 is drawn into the first intermediate vacuum chamber due to a pressure difference between a pressure in the ionization chamber 10 (approximately, the atmospheric pressure) and a pressure in the first intermediate vacuum chamber 11. At this time, the ions pass through inside a heated capillary 102, so that a solvent is removed. In the first intermediate vacuum chamber 11 there is disposed an ion lens 111, and the ion lens 111 converges an ion beam in the vicinity of an ion optical axis C. The ion beam converged in the first intermediate vacuum chamber 11 enters the second intermediate vacuum chamber 12 through a hole at a top part of a skimmer cone 112 provided at a bulkhead part between the first intermediate vacuum chamber 11 and the second intermediate vacuum chamber 12.

In the second intermediate vacuum chamber 12, there are disposed: a quadrupole mass filter 121 to separate the ions depending on the mass-to-charge ratio; a collision cell 123 equipped with a multipole ion guide 122 inside the collision cell 123; and an ion lens 124 (a former stage part of an ion lens 130 which transports ions from the collision cell 123 to an orthogonal accelerator section 132) which transports the ions ejected from the collision cell 123. Inside the collision cell 123, there is supplied a collision-induced dissociation (CID) gas such as argon or nitrogen continuously or intermittently. Note that the multipole ion guide 122 disposed inside the collision cell 123 is disposed such that a space surrounded by a plurality of rod electrodes is gradually wider (spreads out wide) toward an exit of the collision cell 123. Since the above configuration is employed, only by applying a high-frequency voltage to each rod electrode, there is formed a potential gradient to transport the ions toward the exit of the collision cell 123.

In the analysis chamber 13, there are provided: an ion lens 131 (a subsequent-stage part of the ion lens 130 to transport ions from the collision cell 123 to the orthogonal accelerator section 132) which transports the ions having entered from the second intermediate vacuum chamber 12 to the orthogonal accelerator section 132; the orthogonal accelerator section 132 constituted by two electrodes 132A and 132B disposed to sandwich an incident optical axis (the orthogonal acceleration region) of ions; the second accelerator section 133 which accelerates the ions sent out toward a flight space by the orthogonal accelerator section 132; a reflectron 134 (134A and 134B) which forms in the flight space a turnover trajectory of the ions; a flight tube 136 located on an outer periphery of a detector 135 and the flight space; and a back plate 137. The reflectron 134, the flight tube 136, and the back plate 137 define the flight space of the ions.

An ion guide 111 disposed in the first intermediate vacuum chamber 11, the quadrupole mass filter 121, and the collision cell 123 disposed in the second intermediate vacuum chamber 12 are positioned each by being fixed to a wall surface of the corresponding vacuum chamber. Further, the ion lens 124 disposed in the second intermediate vacuum chamber 12 is positioned by being fixed to the collision cell 123. In the analysis chamber 13, a base plate 138 is fixed to a wall surface of the vacuum chamber, and members in the analysis chamber 13 are positioned by being directly or indirectly fixed to the base plate 138. The details will be described later.

The time-of-flight mass spectrometer of the present embodiment is characterized in the followings: a structure of a lead-in electrode 132B constituting the orthogonal accelerator section 132; a mechanism to fix the orthogonal accelerator section 132 and the second accelerator section 133; and a configuration and an arrangement of the ion lens 130 (a former stage-side ion lens 124 and a subsequent stage-side ion lens 131). In the following, these points will be described.

Figure 7:
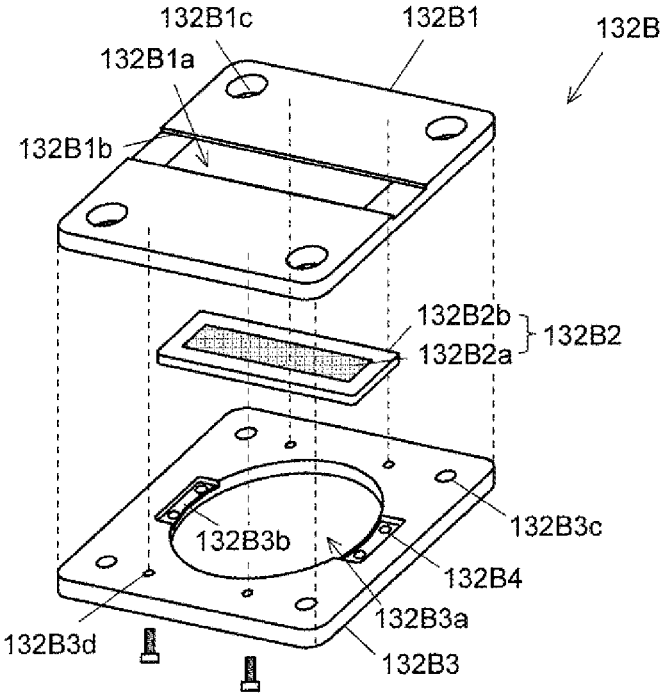
FIG. 7 is a breakdown perspective view of an embodiment of a lead-in electrode according to the present invention.
Figure 8:
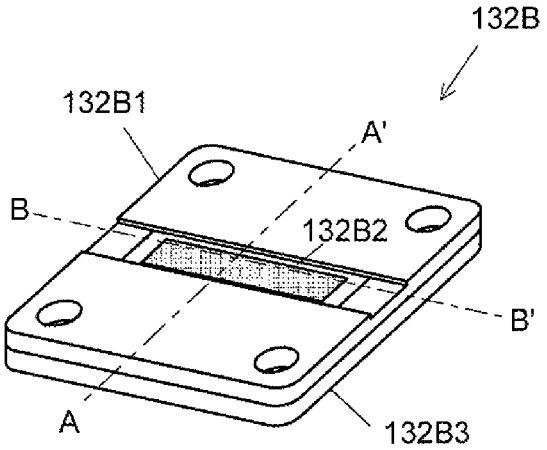
FIG. 8 is a perspective view of the lead-in electrode of the present embodiment.
Figure 9A:
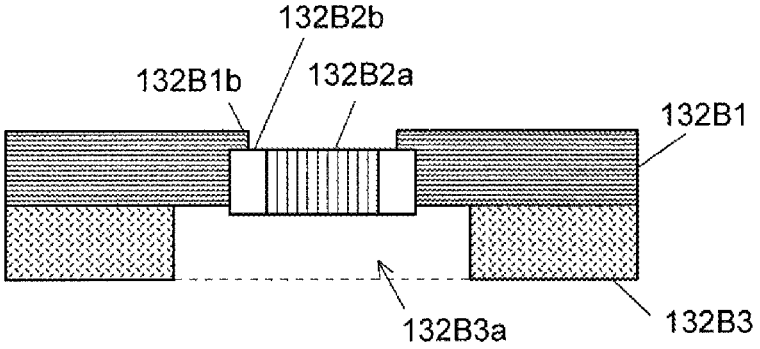
FIGS. 9A and 9B are each a cross-sectional view of the lead-in electrode of the present embodiment.
Figure 9B:
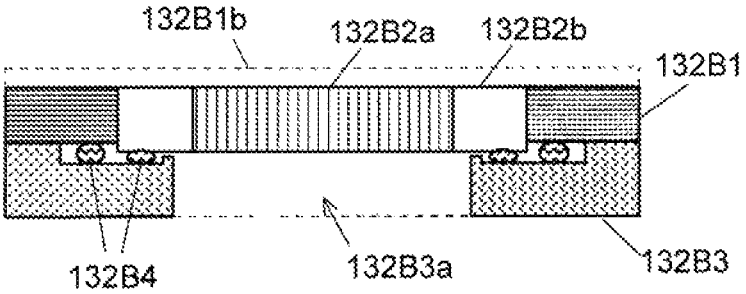

FIG. 7 is a breakdown perspective view of the lead-in electrode 132B of the present embodiment, FIG. 8 is a perspective view of the lead-in electrode 132B when assembled, and FIGS. 9A and 9B are cross-sectional views of the lead-in electrode 132B taken along line A-A' (FIG. 9A) and line B-B' (FIG. 9B).

The lead-in electrode 132B has an upper member 132B1, a main body 132B2, and a lower member 132B3, which are all metal members, and has lead-in electrode elastic members 132B4. The main body 132B2 is rectangular plate-shaped member having: an ion passing part 132B2*a* in which many ion passing holes are formed to penetrate through in a thickness direction; and a peripheral part 132B2*b* formed to surround the ion passing part 132B2*a*. The upper member 132B1 is a plate-shaped member at whose center there is formed a through-hole 132B1*a* having a rectangular cross-section with a size corresponding to an outer shape of the main body 132B2, and on an upper surface of the upper member 132B1, extension parts 132B1*b* are formed to cover parts of the through-hole 132B1*a* (parts, on the long-side sides, of the peripheral part 132B2*b* of the main body 132B2 when accommodated in the through-hole 132B1*a*). The peripheral of the through-hole 132B1*a* is one step lower on the sides of the two sides, of the through-hole 132B1*a*, corresponding to the short sides of the rectangle than on the long-side sides of the rectangle, and has the same height as the lower surface of the extension parts 132B1*b*. That is, when the main body 132B2 is accommodated in the through-hole 132B1*a*, the parts of the peripheral, of the through-hole 132B1*a*, on the sides of the two sides, of the through-hole 132B1*a*, corresponding to the short sides of the rectangle have a height flush with the upper surface of the main body 132B2. Further, in four corners of the upper member 132B1, there are formed through-holes 132B1*c* through which rod-shaped members 139 for fixing the orthogonal accelerator section 132 to an orthogonal acceleration section positioning plate 140 (to be described later) are inserted. In addition, in a lower surface of the upper member 132B1, there are formed four bolt holes used to bolt the upper member 132B1 from a lower member 132B3 side.

The lower member 132B3 is a plate-shaped member at whose center there is formed a circular through-hole 132B3*a* having a diameter that is longer than a short side of the main body 132B2 having a rectangular plate shape and a long side of the ion passing part but is shorter than a length of a long side of the main body 132B2 in the center of the lower member 132B3. That is, the through-hole 132B3*a* of the present embodiment is provided at such a position that an entire part of the ion passing part is not blocked. In two part, of a peripheral part of the through-hole 132B3*a*, located to sandwich a center of the through-hole 132B3*a*, recessed parts 132B3*b* (second area) are formed one step lower than the other part (the first area). Each of the recessed parts 132B3*b* accommodates the lead-in electrode elastic members 132B4. In the present embodiment, each recessed part 132B3*b* accommodates two O-rings (as a result, four O-rings are used in total), but other members than O-rings may be used as the lead-in electrode elastic members 132B4, and it is possible to change the number of the members as necessary. In four corners of the lower member 132B3, there are formed through-holes 132B3*c* in which the above rod-shaped members 139 are inserted. Further, at positions, on the lower member 132B3, corresponding to the bolt holes formed in the lower surface of the upper member 132B1, there are formed four through-hole 132B3*d* through which bolts are inserted.

The lead-in electrode elastic members 132B4 are disposed in the recessed parts 132B3*b* of the lower member 132B3, the main body 132B2 is puts on the lead-in electrode elastic members 132B4, the upper member 132B1 is placed on the main body 132B2, so that the main body 132B2 is accommodated in the through-hole 132B1*a* of the upper member 132B1. Then, bolts are inserted in the through-holes 132B3*d* of the lower member 132B3 to bolt the bolts in the bolt holes in the lower surface of the upper member 132B1. In this way, the lead-in electrode 132B is assembled.

As shown in the cross-sectional view in FIG. 9B taken along line B-B', the lower surface of the main body 132B2 is pushed up by the lower member 132B3 via the lead-in electrode elastic members 132B4. Further, as shown in the cross-sectional view in FIG. 9A taken along line A-A', the upper surface of the main body 132B2 is pushed against the lower surface of the extension parts 132B1*b* of the upper member 132B1. In the above lead-in electrode 132B, even in a case where the main body 132B2 has a thickness unevenness, since the lead-in electrode elastic members 132B4 deform corresponding to the unevenness, the upper surface of the main body 132B2 is surely pressed against the lower surfaces of the extension parts 132B1*b*, thereby preventing the upper surface from being inclined. As described above, the conventional lead-in electrode 232B has a following problem. The lower surface of the lower member 232B3 is curved when the lead-in electrode 232B is assembled, and an electric field formed between the lead-in electrode 232B and the second accelerator section 233 is distorted; therefore, it is difficult to accelerate the ions uniformly. In contrast, in the case of the lead-in electrode 132B of the present embodiment, since the lower surface of the upper member 132B1 and the upper surface of the lower member 132B3 are fixed to each other while the both surfaces are in contact with each other, the lower surface of the lower member 132B3 is not curved, and such a conventional problem as described above does not occur. It is preferable that the lead-in electrode elastic members 132B4 be disposed also between the upper member 132B1 and the lower member 132B3 as in the present embodiment; however, if the lead-in electrode elastic members 132B4 are inserted at least between the main body 132B2 and the lower member 132B3, it can provide the above effect.

Figure 10A:
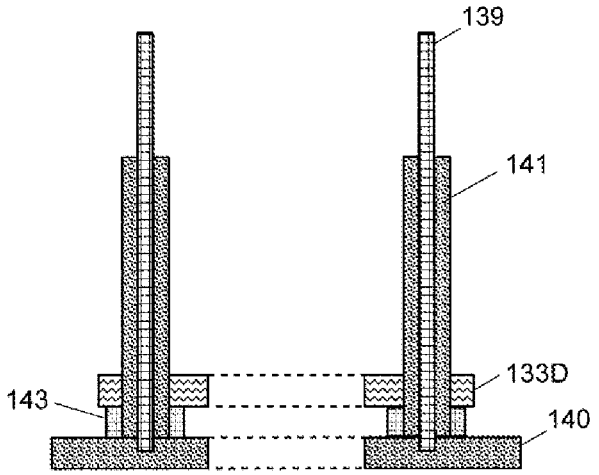
FIGS. 10A, 10B, and 10C are diagrams illustrating steps of fixing an orthogonal accelerator section and a second accelerator section in the orthogonal acceleration time-of-flight mass spectrometer of the present embodiment.
Figure 10B:
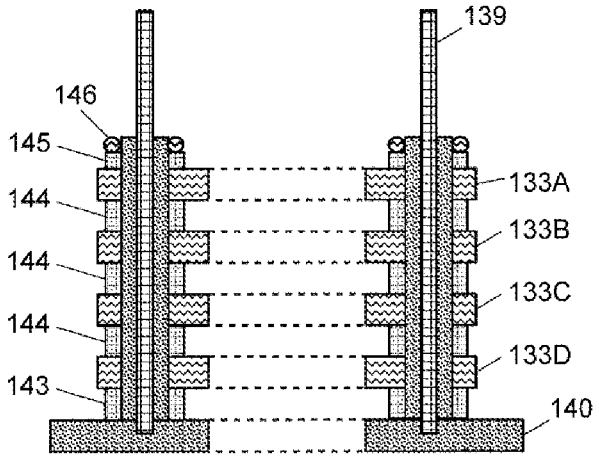
Figure 10C:
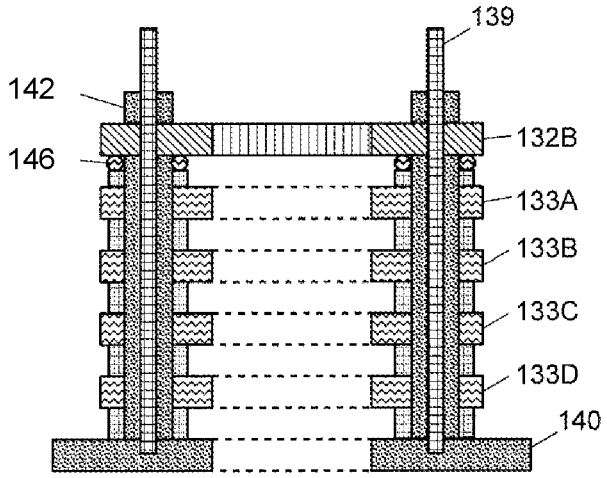
Figure 11:
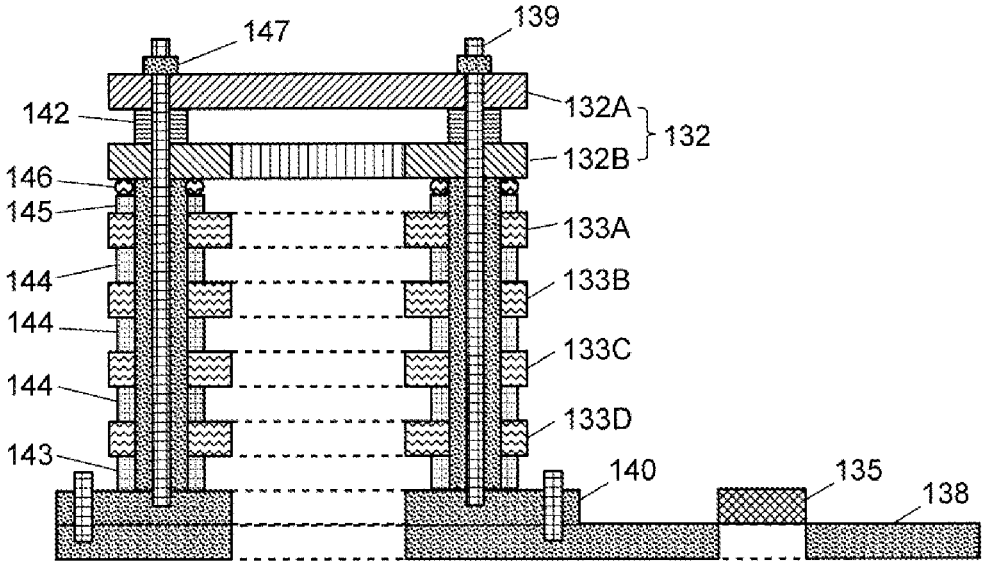
FIG. 11 is a diagram illustrating a fixing mechanism of the orthogonal accelerator section and the second accelerator section in the orthogonal acceleration time-of-flight mass spectrometer of the present embodiment.

Next, with reference to FIGS. 10A, 10B, 10C, and 11, a fixing mechanism of the orthogonal accelerator section 132 and the second accelerator section 133 will be described. FIGS. 10A, 10B, and 10C are diagrams showing the fixing mechanism while being assembled, and FIG. 11 is a diagram showing the fixing mechanism after assembled. As described above, in the analysis chamber 13, the base plate 138 is fixed to the vacuum chamber, and the orthogonal accelerator section 132 and the second accelerator section 133 are positioned with reference to the base plate 138. Note that the detector 135 is directly fixed on the base plate 138 as shown in FIG. 11 in the present embodiment; however, the detector 135 may be fixed via a detachable positioning plate for the detector, or also the detector 135 may be fixed on the orthogonal acceleration section positioning plate 140 to be described later. To the base plate 138, the orthogonal acceleration section positioning plate 140 (in the following, also referred to as a "positioning plate") is detachably attached.

When the orthogonal accelerator section 132 and the electrodes constituting the second accelerator section 133 are attached, the rod-shaped members 139 (only two of them are shown in FIGS. 10A, 10B, and 10C) in each of whose outer circumferences a thread groove is formed are fixed to corresponding four bolt holes formed in the upper surface of the positioning plate 140. Next, first spacer members 141 in each of which a through-hole having a size corresponding to an outer circumference of the rod-shaped member 139 is formed are inserted into the rod-shaped members 139. The first spacer members 141 are attached one to each rod-shaped member 139 (in the same way, regarding second spacer members 142, third spacer members 143, fourth spacer members 144, and fifth spacer members 145 to be described later, one is attached to each rod-shaped member 139). Further, each spacer member used in the present embodiment is an insulating member made of ceramic. Resin members can be used as the spacer members, but if the spacer members are deformed, the positions of the members positioned via the spacer members are displaced. Therefore, it is preferable to use spacer members made of ceramic, which has higher stiffness than resin.

Next, the third spacer members 143 in each of which a through-hole having a size corresponding to an outer circumference of the first spacer member 141 is formed are inserted into the first spacer members 141. Then, on the third spacer members 143, a second acceleration electrode 133D, which is one of second acceleration electrodes 133A to 133D constituting the second accelerator section 133 and is disposed on the side closest to the flight space, is inserted. In each of the second acceleration electrode 133A to 133D, there are formed four through-holes (the same number as the rod-shaped members 139) each having a size corresponding to the outer circumference of the first spacer members. FIG. 10A is a diagram showing a state where the second acceleration electrode 133D is inserted.

After that, the fourth spacer members 144 and the second acceleration electrodes 133C, 133B, and 133A constituting the second accelerator section 132 are inserted into the first spacer members 141 alternately. After the second acceleration electrode 133A (which is the second acceleration electrode attached at the position most distant from the base plate 138) is attached, the fifth spacer members 145 are attached on the second acceleration electrode 133A, and a positioning and securing elastic members 146 (O-rings) are attached on the fifth spacer members 145. The positioning and securing elastic members 146 (O-ring) are attached one to each of the rod-shaped members 139. FIG. 10B is a diagram showing a state where the positioning and securing elastic members 146 are attached. Note that in the present embodiment, the second accelerator section 132 are constituted by four electrodes, and it is possible to change the number of the electrodes constituting the second accelerator section 132 as necessary.

Subsequently, on the positioning and securing elastic members 146, the lead-in electrode 132B, in which four through-holes each corresponding to the outer shape of the rod-shaped member 139 are formed, is attached. Then, on the lead-in electrode 132B, the second spacer members 142 are attached. FIG. 10C is a diagram showing this state. Further, in the holes of the expulsion electrode 132A, the rod-shaped members are inserted to attach the expulsion electrode 132A. For example, by attaching nuts 147 to the rod-shaped members 139 from above the expulsion electrode 132A, or by another method, the orthogonal accelerator section 132 (the expulsion electrode 132A and the lead-in electrode 132B) and the second accelerator section 133 are fixed to the positioning plate 140. Finally, the positioning plate 140 is fixed to the base plate 138 (FIG. 11).

Figure 1:
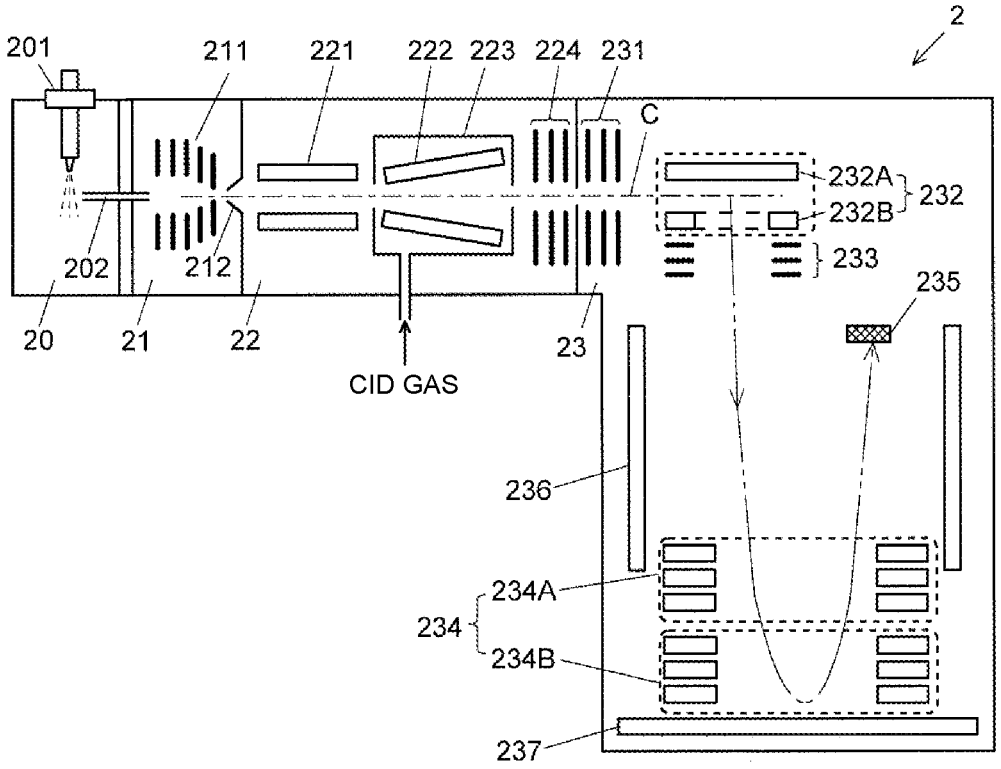
FIG. 1 is a schematic configuration view of a conventional orthogonal acceleration time-of-flight mass spectrometer.
Figure 2:
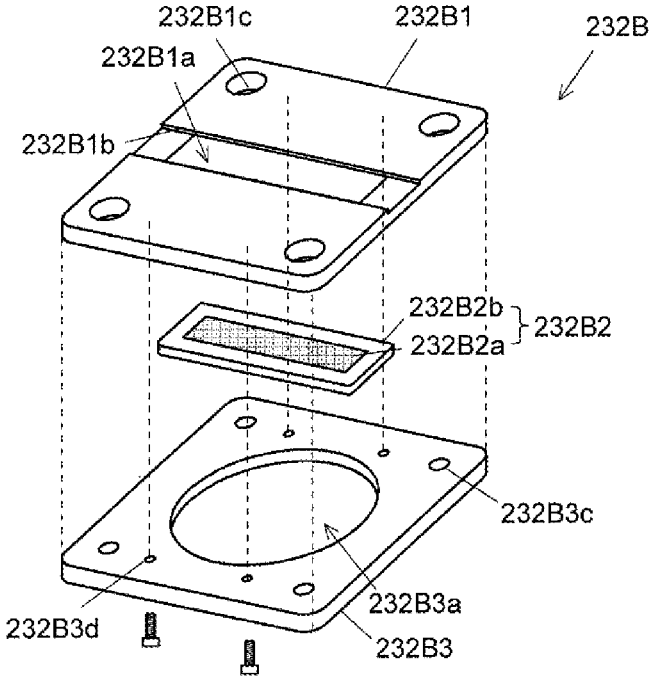
FIG. 2 is a breakdown perspective view of a conventional lead-in electrode.
Figure 3:
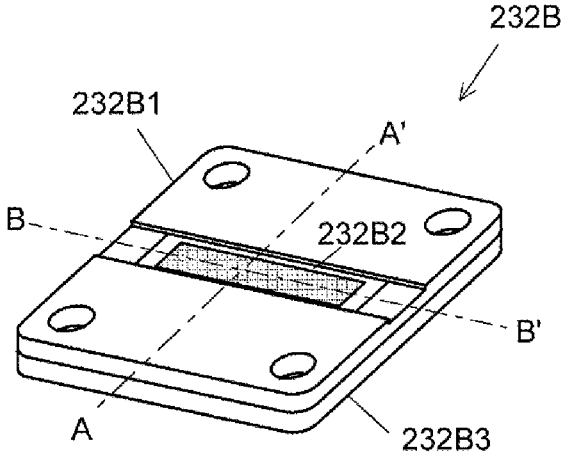
FIG. 3 is a perspective view of the conventional lead-in electrode.
Figure 4A:
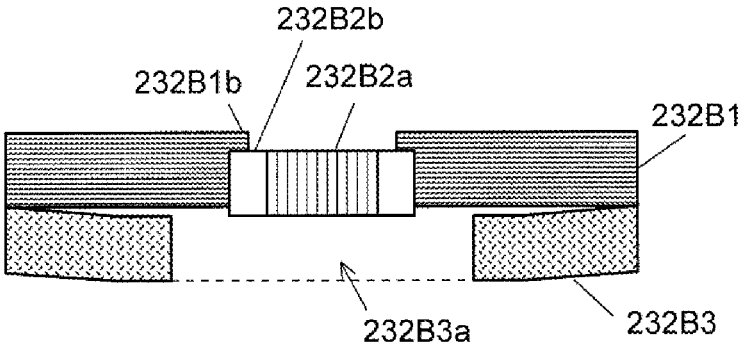
FIGS. 4A and 4B are cross-sectional views of the conventional lead-in electrode.
Figure 4B:
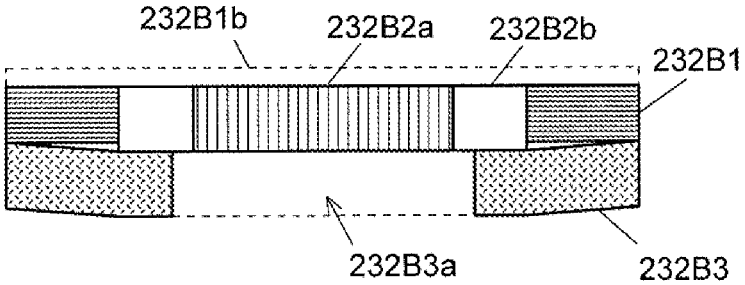
Figure 5:
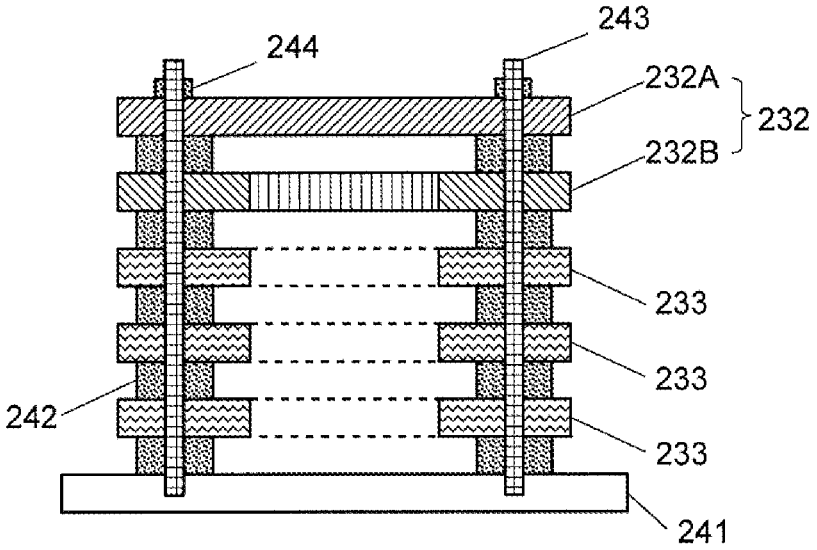
FIG. 5 is a diagram illustrating a fixing mechanism of a conventional orthogonal accelerator section and a second accelerator section.

In the conventional configuration (see FIG. 5), the spacer members 242 and the electrodes 233 constituting the second accelerator section are alternately attached on the base plate 241, and the lead-in electrode 232B is attached on this assembly. In addition, the expulsion electrode 232A is attached and fixed on the lead-in electrode 232B via the spacer members 242. Due to such a configuration, errors of the spacer members 242 and the electrodes constituting the second accelerator section 233 are accumulated on the expulsion electrode 232A and the lead-in electrode 232B fixed at positions distant from the base plate, and there tends to occur deterioration in accuracy of the distances from the base plate 241 to the lead-in electrode 232B and the expulsion electrode 232A, in degrees of parallelism between the base plate 241 and the both electrodes, and in a degree of parallelism between the opposing surfaces of the expulsion electrode 232A and the lead-in electrode 232B. As a result, the ions are not accelerated uniformly, and the resolution power and the sensitivity are sometimes decreased.

In contrast, in the configuration of the present embodiment, the distance from the base plate 138 (strictly, the positioning plate 140) to the lead-in electrode 132B is defined only by the first spacer members 141. Further, the distance from the base plate 138 (strictly, the positioning plate 140) to the expulsion electrode 132A is defined only by the first spacer members 141 and the second spacer members 142. That is, the accuracy of the distances from the base plate 138 to the expulsion electrode 132A and the lead-in electrode 132B, the degree of parallelism between the opposing surfaces of the both electrodes, and the degrees of parallelism between the base plate and the both electrodes are never influenced by dimension errors and flatness errors of the third spacer members 143, the fourth spacer members 144, and the fifth spacer members 145 at the time of manufacturing. Therefore, it is possible to improve, compared to before, the accuracy of the distances from the base plate 138 to the expulsion electrode 132A and the lead-in electrode 132B, the degrees of parallelism between the base plate and the both electrodes, and the degree of parallelism between the opposing surfaces of the expulsion electrode 132A and the lead-in electrode 132B, thereby improving the resolution power and the sensitivity. Note that in the present embodiment, the orthogonal acceleration section positioning plate 140 is used so that a work of fixing the orthogonal accelerator section 132 and the electrodes constituting the second accelerator section 133 can be performed outside the vacuum chamber. However, it is possible to fix the orthogonal accelerator section 132 and the second accelerator section 133 directly to the base plate 138 without using the positioning plate 140. Note that positioning and securing elastic members 146 are not essential, but the positioning and securing elastic members 146 surely absorb the thickness error and the flatness error, at the time of manufacturing, of the third spacer members 143, the fourth spacer members 144, and the fifth spacer member 145, so that the first spacer members 141 and the second spacer members 142 can position the orthogonal accelerator section 132 more accurately.

Figure 12:
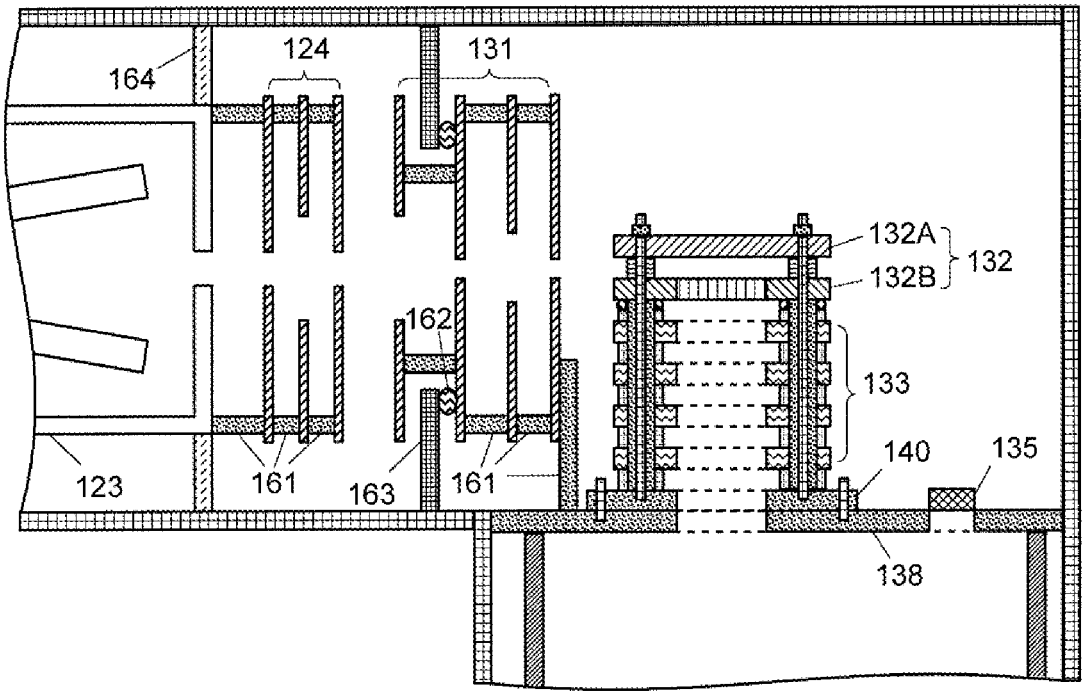
FIG. 12 is a partially enlarged diagram of the orthogonal acceleration time-of-flight mass spectrometer of the present embodiment.
Figure 13:
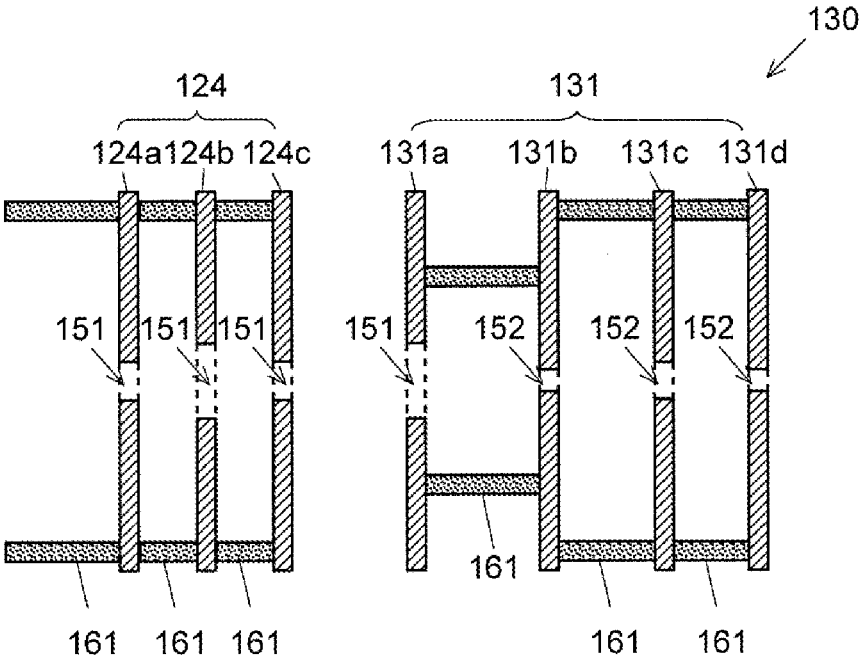
FIG. 13 is a diagram illustrating a configuration of an ion lens of the orthogonal acceleration time-of-flight mass spectrometer of the present embodiment.

Next, a description will be given on the ion lens 130 (124 and 131) disposed on a boundary portion between the second intermediate vacuum chamber 12 and the analysis chamber 13. FIG. 12 is an enlarged view of a vicinity of the boundary between the second intermediate vacuum chamber 12 and the analysis chamber 13. FIG. 13 is a diagram showing only a configuration of the ion lens 130.

The ion lens 130 is used to converge the ion beam having passed through the collision cell 123 and to transport the ion beam to the orthogonal accelerator section 132. The collision cell 123 is disposed in the second intermediate vacuum chamber 12, and the orthogonal accelerator section 132 is disposed in the analysis chamber. Therefore, the ion lens 130 is disposed separately in the two spaces.

Figure 14A:
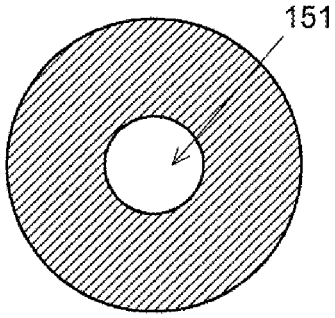
FIGS. 14A and 14B are diagrams each illustrating a shape of an ion passing opening of the ion lens of the present embodiment.
Figure 14B:
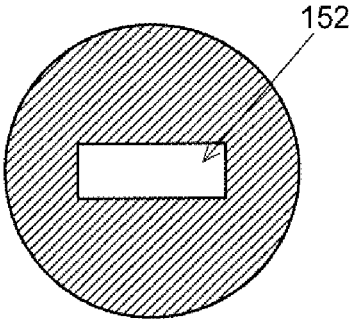

The ion lens 130 of the present embodiment is configured with seven circular plate-shaped electrodes and is divided into the former stage-side ion lens 124 constituted by three electrodes 124*a*, 124*b*, and 124*c* on a former stage side (collision cell 123 side) and the subsequent stage-side ion lens 131 constituted by four electrodes 131*a*, 131*b*, 131*c*, and 131*d* on a subsequent stage side (orthogonal accelerator section 132 side). There is formed a circular ion passing opening 151 at a center of each of the electrodes 124*a*, 124*b*, and 124*c* constituting the former stage-side ion lens 124 and the electrode 131*a*, which is one of the electrodes constituting the subsequent stage-side ion lens 131 and is located on the frontmost stage side (FIG. 14A). On the other hand, there is formed a rectangular slit 152 at a center of each of the three electrodes 131*b*, 131*c*, and 131*d*, of the electrodes constituting the subsequent stage-side ion lens 131, located on the subsequent stage side (FIG. 14B). These electrodes also have a function of a slit to shape the ion beam. Further, the holes formed in the electrodes do not have the same size but have such sizes that each electrode has a converging property corresponding to a position of the each electrode (that is, each hole has such a size that when voltages are applied, the electrodes converge the ion beam toward the hole of the neighboring ion lens on the subsequent stage side).

The ion lens 130 of the present embodiment has one feature in that the ion passing opening 151 of the electrode 131*a*, which is one of the electrodes constituting the subsequent stage-side ion lens 131 and is located on the frontmost stage side, is larger than the ion passing opening 151 of the electrode 124*c*, which is one of the electrodes constituting the former stage-side ion lens 124 and is located on the rearmost stage side.

As shown in FIGS. 12 and 13, the three electrodes 124*a*, 124*b*, and 124*c* constituting the former stage-side ion lens 124 are fixed to one another via insulating members 161 made of resin or other materials. The electrode 124*a* located on the frontmost stage side of the former stage-side ion lens 124 is fixed to the collision cell 123 via the insulating members 161, and this arrangement positions the former stage-side ion lens 124. Note that the collision cell 123 is fixed to the vacuum chamber via a fixing member 164.

In the same manner, the four electrodes 131*a* to 131*d* constituting the subsequent stage-side ion lens 131 are fixed to one another via the insulating members 161 made of resin or other materials. The electrode 131*d* located on the rearmost stage side of the subsequent stage-side ion lens 131 is fixed to the base plate 138 via the insulating members 161, and this arrangement positions the subsequent stage-side ion lens 131. In the present embodiment, the electrode 131*d* is fixed to the base plate 138 but may be fixed to the orthogonal acceleration section positioning plate 140. As described above, the orthogonal acceleration section positioning plate 140 is fixed to the base plate 138. The subsequent stage-side ion lens 131 is fixed to the base plate 138 directly or indirectly.

As described above, the former stage-side ion lens 124 and the subsequent stage-side ion lens 131 are disposed independently from each other and are positioned relative to different members. For this reason, there is a possibility that there occurs misalignment between the ion optical axis of the former stage-side ion lens 124 and the ion optical axis of the subsequent stage-side ion lens 131. If, due to such misalignment of ion optical axis, a part of the ions having passed through the electrode 124*c* located on the rearmost stage side of the former stage-side ion lens 124 do not enter the ion passing opening 151 of the electrode 131*a* located on the frontmost stage side of the subsequent stage-side ion lens 131, the sensitivity is reduced by a magnitude corresponding to the ions which do not enter the ion passing opening 151.

As described above, the ion lens 130 of the present embodiment is configured such that the ion passing opening 151 of the electrode 131*a*, which is one of the electrodes constituting the subsequent stage-side ion lens 131 and is located on the frontmost stage side, is larger than the ion passing opening 151 of the electrode 124*c*, which is one of the electrodes constituting the former stage-side ion lens 124 and is located on the rearmost stage side. That is, the ion lens 130 is divided into the former stage-side ion lens 124 and the subsequent stage-side ion lens 131 so that the ion beam narrowed down to have a small diameter by the electrode 124*c* enters the ion passing opening 151, of the electrode 131*a*, having a large diameter. Therefore, even if some misalignment of ion optical axis occurs between the former stage-side ion lens 124 and the subsequent stage-side ion lens 131 when these two ion lenses are fixed, a decrease in sensitivity due to loss of ions does not occur. In particular, the ion lens 130 of the present embodiment is configured such that the electrode 131*a*, which is one of the electrodes constituting the ion lens 130 and whose ion passing opening 151 has the largest diameter, is located on the frontmost stage side of the subsequent stage-side ion lens 131, and this configuration decreases the decrease in sensitivity due to the loss of ions as much as possible.

Further, in the ion lens 130 of the present embodiment, the electrode 131*b* located on the second position, in the subsequent stage-side ion lens 131, from the former stage side is fixed also to a bulkhead member 163 via a seal member (for example, O-ring) 162, and the electrode 131*b* separates the second intermediate vacuum chamber 12 from an internal space of the analysis chamber 13. The ion passing opening 151 of the electrode 131*b* fixed to the bulkhead member 163 via the seal member 162 is smaller than the ion passing opening 151 of the electrode 131*a* located on the previous stage. Therefore, this configuration can keep larger the difference in degree of vacuum between the second intermediate vacuum chamber 12 and the analysis chamber 13 than in a configuration where the electrode 131*a* is fixed to the bulkhead member 163 (that is, this configuration can keep high the degree of vacuum in the analysis chamber 13).

In addition, in the present embodiment, the base plate 138 used as a reference for positioning of the subsequent stage-side ion lens 131 is also used for positioning of the orthogonal accelerator section 132 and the second accelerator section 133. That is, the configuration is made such that there occurs no misalignment of the ion optical axis C between the subsequent stage-side ion lens 131 and the orthogonal accelerator section 132 (in addition, the second accelerator section 133). Therefore, it is possible to precisely transport the ion beam, which is converged by the electrodes 131*a* to 131*d* of the subsequent stage-side ion lens 131 and is shaped by the slits 152 of the electrodes 131*b*, 131*c*, and 131*d*, to the orthogonal acceleration region in the orthogonal accelerator section 132. Further, because the base plate 138 positions also the reflectron 134, the flight tube 136, the back plate 137, and the detector 135, it is possible to guide the ions accelerated by the orthogonal accelerator section 132 and the second accelerator section 133 to the detector 135 by causing the ions to fly without deviating from a predetermined trajectory.

The above embodiment is merely an example and can be modified as necessary without departing from the subject matter of the present invention. In the present embodiment, the through-hole 132B3*a* is provided at such a position that an entire part of the ion passing part is not blocked. However, this configuration is a preferable aspect, and when the through-hole 132B3*a* is provided at such a position that at least a part of the ion passing part is not blocked, it is possible to emit the ions from the lead-in electrode 132B. Further, in the present embodiment, the configuration is made such that the ions enter the orthogonal accelerator section 132 in the horizontal direction and such that the orthogonal accelerator section 132 and the second accelerator section 133 accelerate the ions downward. However, this configuration is an example, and the orthogonal accelerator section 132 and the second accelerator section 133 may accelerate the ions upward or in the horizontal direction. For example, in the case of accelerating the ions upward, the arrangement may be made to suspend, below the base plate 138 (and the orthogonal acceleration section positioning plate 140), the electrodes constituting the second accelerator section 133, the lead-in electrode 132B, and the expulsion electrode 132A. Further, in the present embodiment, a plurality of electrodes constitute the second accelerator section 133, but only one electrode may constitute the second accelerator section 133. In that case, the fourth spacer member 144 is not necessary. In addition, the present embodiment includes the quadrupole mass filter 121 and the collision cell 123, but a configuration similar to the above embodiment can be used in an orthogonal acceleration type time-of-flight mass spectrometer which has only one of the quadrupole mass filter 121 and the collision cell 123.

REFERENCE SIGNS LIST

1 . . . Orthogonal Acceleration Time-of-flight Mass Spectrometer
10 . . . Ionization Chamber
101 . . . Electrospray Ion Source
102 . . . Capillary
11 . . . First Intermediate Vacuum Chamber
111 . . . Ion Guide
112 . . . Skimmer Cone
12 . . . Second Intermediate Vacuum Chamber
121 . . . Quadrupole Mass Filter
122 . . . Multipole Ion Guide
123 . . . Collision Cell
124 . . . Former Stage-side Ion Lens
13 . . . Analysis Chamber
130 . . . Ion Lens
131 . . . Subsequent Stage-side Ion Lens
132 . . . Orthogonal Accelerator Section
132A . . . Expulsion Electrode
132B . . . Lead-in Electrode
132B1 . . . Upper Member
132B1*a* . . . Through-hole
132B1*b* . . . Extension Part
132B2 . . . Main Body
132B2*a* . . . Ion Passing Part
132B3 . . . Lower Member
132B4 . . . Lead-in Electrode Elastic Member
133 . . . Second Accelerator Section
134 . . . Reflectron
135 . . . Detector
136 . . . Flight Tube
137 . . . Back Plate
138 . . . Base Plate
139 . . . Rod-shaped Member
140 . . . Orthogonal Acceleration Section Positioning Plate
41 . . . First Spacer Member
142 . . . Second Spacer Member
143 . . . Third Spacer Member
144 . . . Fourth Spacer Member
145 . . . Fifth Spacer Member
146 . . . Positioning And Securing Elastic Member
147 . . . Nut
151 . . . Ion Passing Opening
152 . . . Slit
161 . . . Insulating Member
162 . . . Seal Member
163 . . . Bulkhead Member
164 . . . Fixing Member
C . . . Ion Optical Axis

The invention claimed is:

1. A lead-in electrode of an orthogonal acceleration time-of-flight mass spectrometer, the lead-in electrode comprising:

(a) a main body having a plate shape, the main body having an ion passing part;

(b) a first member which is a plate-shaped member in which there is provided a main-body accommodating part which is a through-hole and accommodates the main body, wherein on one surface of the first member there is provided an extension part to delimit a position of one surface of the main body accommodated in the main-body accommodating part;

(c) a second member which is a plate-shaped member and is to be attached to the first member accommodating the main body in the main-body accommodating part, wherein a through-hole is provided at such a position of the second member that at least a part of the ion passing part is not blocked, and on one surface of the second member there are formed a first area which is in contact with a surface opposite to the one surface of the first member and a second area which is located inside with respect to the first area and is formed lower than a surface, of the first area, in contact with the surface opposite to the one surface of the first member; and (d) an elastic member disposed, in the second area, between the main body and the second member.

2. The lead-in electrode according to claim 1, wherein the second area is formed in a recessed shape.

3. An orthogonal acceleration time-of-flight mass spectrometer comprising:

(e) an orthogonal accelerator section having the lead-in electrode according to claim 1 and an expulsion electrode;

(f) a second accelerator section constituted by one or a plurality of electrodes;

(g) a base plate;

(h) a plurality of rod-shaped members provided to stand on the base plate;

(i) first spacer members each of which is a member attached to a respective one of the plurality of rod-shaped members and defines a distance from the base plate to the lead-in electrode;

(j) second spacer members each of which is a member attached to a respective one of the plurality of rod-shaped members and defines a distance from the lead-in electrode to the expulsion electrode; and (k) third spacer members each of which is a member attached to a respective one of the rod-shaped members and defines a distance from the base plate to an electrode which is one of the electrodes constituting the second accelerator section and is disposed at a position closest to the base plate.

4. The orthogonal acceleration time-of-flight mass spectrometer according to claim 3, wherein the second accelerator section includes a plurality of electrodes, and the orthogonal acceleration time-of-flight mass spectrometer further comprises:

(l) fourth spacer members each of which is a member attached to a respective one of the rod-shaped members and defines the distances between the electrodes constituting the second accelerator section.

5. The orthogonal acceleration time-of-flight mass spectrometer according to claim 3, wherein the first spacer member and the second spacer member are made of ceramic.

6. An orthogonal acceleration time-of-flight mass spectrometer, comprising:

(m) a high vacuum chamber in which an orthogonal accelerator section having the lead-in electrode according to claim 1 and an expulsion electrode is disposed;

(n) an intermediate vacuum chamber provided on a former stage of the high vacuum chamber; and (o) an ion lens configured with: a former stage-side ion lens which is positioned relative to a member located inside the intermediate vacuum chamber and is constituted by one or a plurality of electrodes in each of which an ion passing opening is formed; and a subsequent stage-side ion lens which is positioned relative to a member located inside the high vacuum chamber and is constituted by one or a plurality of electrodes in each of which an ion passing opening is formed, wherein the ion passing opening in one of the electrodes located on a frontmost stage of the subsequent stage-side ion lens is larger than the ion passing opening of one of the electrodes located on a rearmost stage of the former stage-side ion lens.

7. The orthogonal acceleration time-of-flight mass spectrometer according to claim 6, wherein the ion passing opening of an electrode which is one of the electrodes constituting the ion lens and is located on a frontmost stage of the subsequent stage-side ion lens is a largest of the ion passing openings of all the electrodes constituting the ion lens.

8. The orthogonal acceleration time-of-flight mass spectrometer according to claim 6, wherein an ion passing opening having a slit shape is formed in at least one of the electrodes that constitutes the subsequent stage-side ion lens and that is other than an electrode located on the frontmost stage of the subsequent stage-side ion lens.

9. The orthogonal acceleration time-of-flight mass spectrometer according to claim 6, wherein the subsequent stage-side ion lens and the orthogonal accelerator section are fixed to a same member directly or indirectly to be positioned to each other.

10. The orthogonal acceleration time-of-flight mass spectrometer according to claim 6, wherein one electrode which is one of the electrodes constituting the subsequent stage-side ion lens and whose ion passing opening is smaller than the ion passing opening formed in the electrode located on the frontmost stage constitutes a part of a vacuum bulkhead between the high vacuum chamber and the intermediate vacuum chamber.

* * * * *